US009057561B2

(12) United States Patent
Giesemann et al.

(10) Patent No.: US 9,057,561 B2
(45) Date of Patent: Jun. 16, 2015

(54) INDUSTRIAL OVEN HAVING A ROTARY PIPE

(75) Inventors: Reinhard Giesemann, Harsewinkel (DE); Ewald Heidebur, Wadersloh (DE)

(73) Assignee: ThyssenKrupp Industrial Solutions AG (DE)

( * ) Notice: Subject to any disclaimer, the term of this patent is extended or adjusted under 35 U.S.C. 154(b) by 889 days.

(21) Appl. No.: 12/965,213

(22) Filed: Dec. 10, 2010

(65) Prior Publication Data

US 2011/0143298 A1 Jun. 16, 2011

(30) Foreign Application Priority Data

Dec. 15, 2009 (DE) ..... 10 2009 058 311

(51) Int. Cl.
*F27B 7/24* (2006.01)

(52) U.S. Cl.
CPC ..... *F27B 7/24* (2013.01)

(58) Field of Classification Search
USPC ..... 277/421, 423, 352; 432/242
See application file for complete search history.

(56) References Cited

U.S. PATENT DOCUMENTS 3,552,721 A * 1/1971 Phillips ..... 366/135
3,698,697 A 10/1972 Gillies et al.
4,115,136 A * 9/1978 Hansen ..... 106/751
4,545,764 A 10/1985 Gillies et al.
4,813,689 A 3/1989 Statler et al.
5,906,435 A * 5/1999 Callaghan et al. ..... 366/220
6,578,850 B1 * 6/2003 Rothlisberger ..... 277/423

FOREIGN PATENT DOCUMENTS

DE 1280475 10/1968
DE 1157528 11/1968

* cited by examiner

*Primary Examiner* — Alissa Tompkins
*Assistant Examiner* — John Bargero
(74) *Attorney, Agent, or Firm* — Renner Kenner Greive Bobak Taylor & Weber

(57) ABSTRACT

The industrial oven according to the invention has a rotary pipe and a fixed material supply device which is connected in the region of a front-face opening of the rotary pipe, there being provided between the rotary pipe and the material supply device a sealing arrangement which comprises a gas seal which is delimited from the operating chamber of the rotary pipe acted upon with material by at least a first gap between the rotary pipe and the material supply device. The sealing arrangement further has an annular chamber which is provided between the first gap and the gas seal and which has a discharge opening which is connected to the operating chamber. A lifting device is further provided in the annular chamber in order to lift out of the operating chamber material which has become introduced into the annular chamber through the first gap and to convey it back to the operating chamber through the discharge opening.

10 Claims, 4 Drawing Sheets

INDUSTRIAL OVEN HAVING A ROTARY PIPE

TECHNICAL FIELD

The invention relates to an industrial oven having a rotary pipe and a fixed material supply device which is connected in the region of a front-face opening of the rotary pipe.

BACKGROUND OF THE INVENTION

Such industrial ovens are used, for example, as so-called retort ovens and serve, for example, to thermally process metals. Another field of application is in thermally processing oil shale in order to obtain oil vapour.

So that the thermal processing can be carried out in a defined atmosphere, there is provided between the rotary pipe and the supply device a sealing arrangement which comprises a gas seal. In that manner, it is also possible to adjust in the operating chamber a selective pressure (in accordance with the method, this may be excess or reduced pressure).

A necessary gap is provided between the rotating rotary pipe and the fixed material supply device and has dimensions which are as small as possible in order to prevent material from the operating chamber from reaching the gas seal via the gap.

In specific applications such as, for example, processing oil shale, the rotary pipe is operated with a material filling level of approximately 50% and more. Owing to the high filling level, the use of a rotating transfer wall or the like for introducing the material into the operating chamber is impossible.

Therefore, it has already been proposed to place a material supply chute having an upright end wall upstream of the rotating rotary pipe. Owing to the high filling level and the resultant high hydrostatic pressure in the material mound of the operating chamber, a substantial quantity of material is urged through the gap within a relatively short space of time in the ovens known in practice. Subsequently, the material quickly reaches the gas seal so that it is destroyed in a relatively short time.

DE2119650A therefore proposed a sealing arrangement which comprises a fixed cylinder which is connected to a material supply device and a cylinder which rotates with a rotary pipe, there being formed between the two cylinders an annular space, in which a helical screw component which rotates with the rotary pipe is arranged in order to convey any powder-like material which has been introduced into the annular space back into the rotary pipe. However, the material located in the rotary pipe impedes this operation so that adequate sealing is ensured in the rotary pipe only at relatively low filling levels. At relatively high filling levels of, for example, more than 50%, the material is urged out of the rotary pipe into the annular space in a substantially increased manner.

SUMMARY OF THE INVENTION

Therefore, an object of the invention is to improve the sealing arrangement in such an industrial oven so that the gas seal is better protected from any material which is discharged from the operating chamber.

According to the invention, this object is achieved by the features of claim 1.

The industrial oven according to the invention has a rotary pipe and a fixed material supply device which is connected in the region of a front-face opening of the rotary pipe, there being provided between the rotary pipe and the material supply device a sealing arrangement which comprises a gas seal which is delimited from the operating chamber of the rotary pipe acted upon with material by at least a first gap between the rotary pipe and the material supply device. The sealing arrangement further has an annular chamber which is provided between the first gap and the gas seal and which has a discharge opening which is connected to the operating chamber. A lifting device is further provided in the annular chamber in order to lift out of the operating chamber material which has become introduced into the annular chamber through the first gap and to convey it back to the operating chamber through the discharge opening.

The invention is based on the notion that the gap can be reduced only to a limited extent. Consequently, it is impossible to prevent material from inevitably accumulating at the gap in the case of a high filling level of 50% and more and a portion of the material from being urged through the gap in the course of time. Owing to the lifting device arranged in the annular chamber, however, this material is then lifted and directed back in the operating chamber again through the discharge opening so that at least a majority of the material introduced through the gap is kept away from the gas seal and is directed back in the operating chamber.

The service-life of the gas seal can thereby be substantially increased, with not only costs for the gas seal being able to be saved but also shorter down-times of the industrial oven being produced.

The dependent claims relate to other constructions of the invention.

According to a preferred construction of the invention, the sealing arrangement comprises a fixed cylinder which is connected to the material supply device and a cylinder which rotates with the rotary pipe, the annular chamber being delimited by the two cylinders. It is particularly possible to make provision for the discharge opening to be constructed in the fixed cylinder. Consequently, the discharge opening is preferably arranged so as to be fixed above a material level which is formed during operation of the rotary pipe.

According to another construction of the invention, there are provided in a region of the annular chamber guiding elements which are constructed in the manner of a screw conveyor and are orientated in such a manner that any material reaching the region of the guiding elements is conveyed into the lifting device with a predetermined direction of rotation of the rotary pipe. In that manner, there is also picked up material that could not be conveyed back into the operating chamber by means of the lifting device the first time. Consequently, those guiding elements constitute an additional, optional means for protecting the gas seal. Those guiding elements can be constructed in particular in the manner of a one-strand or multiple-strand screw.

The lifting device is advantageously formed by a plurality of lifting shovels which are arranged so as to be distributed over the periphery and which rotate with the rotary pipe.

It is further possible to delimit in the annular chamber a preliminary chamber which is connected to the operating chamber via the first gap and is connected to the remainder of the annular chamber via a second gap. That preliminary chamber has a delimiting wall which rotates with the rotary pipe and which is provided with a plurality of openings, via which any material which may be introduced into the preliminary chamber via the first gap reaches the lifting device directly.

The material supply device can further have a static end wall, with which the end-face opening of the rotary pipe is closed, and can comprise a supply chute which opens in the fixed cylinder which is secured to the end wall.

According to a third means for protecting the gas seal, there can further be provision for a third gap, which connects the annular chamber to an overflow device, to be provided between the cylinder which rotates with the rotary pipe and the end wall.

Whereas the lifting device alone already constitutes a very effective means for protecting the gas seal, the guiding elements and/or the overflow device afford the gas seal additional protection. Owing to a combination of all three means, the gas seal is substantially 100% protected from any material from the operating chamber.

BRIEF DESCRIPTION OF THE DRAWINGS

Other advantages and constructions of the invention will be explained in greater detail below with reference to the description and the drawings, in which.

DETAILED DESCRIPTION OF ILLUSTRATIVE EMBODIMENTS

Figure 1:
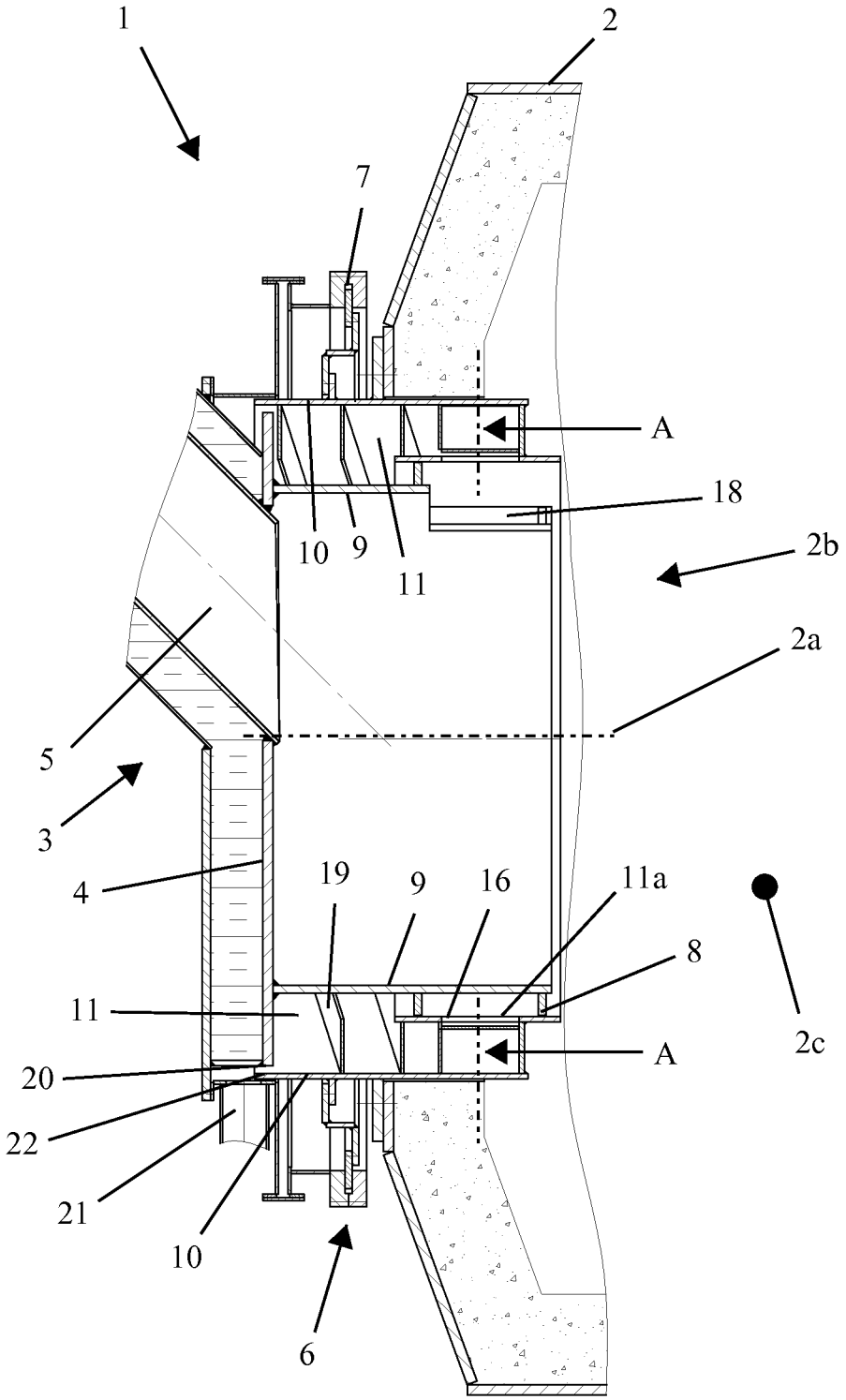
FIG. 1 is a sectional illustration of the industrial oven in the region of the material supply device.

FIG. 1 shows an industrial oven 1 which is particularly in the form of a retort oven for thermally processing oil shale. It substantially comprises a rotary pipe 2 which rotates about an axis 2*a* and a fixed material supply device 3 which is connected in the region of a front-face opening 2*b*. The material supply 3 comprises a static end wall 4, with which the front-face opening 2*b* of the rotary pipe 2 is closed, and a supply chute 5.

There is further provided a sealing arrangement 6 which comprises a gas seal 7 which is conventional in this context. It is constructed in such a manner that it can compensate for both the tumbling movement and any vertical impacts of the rotary pipe 2. Such a gas seal is described in greater detail, for example, in EP0274090 B1.

It further has a fixed cylinder 9 which is connected to the static end wall 4 of the material supply device 3 and a cylinder 10 which rotates with the rotary pipe, there being delimited between the two cylinders 9, 10 an annular chamber 11 which is connected to the operating chamber 2*c* of the rotary pipe 2 via a first gap 8.

Figure 2:
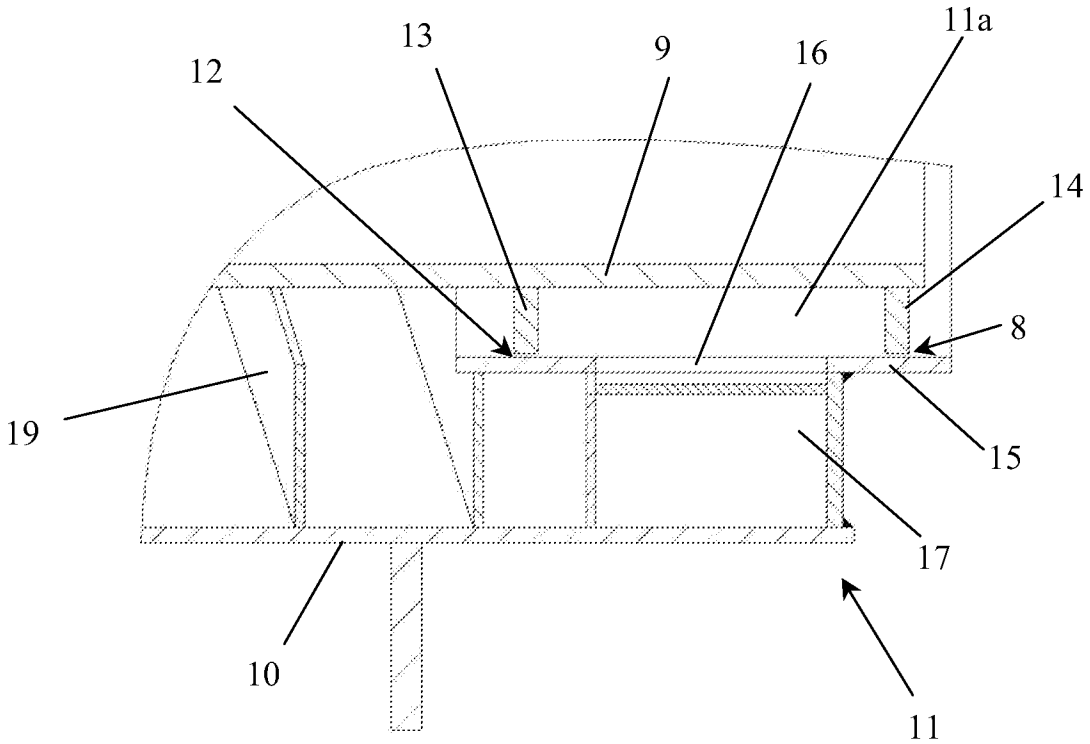
FIG. 2 is an enlarged sectional illustration in the region of the annular chamber.

The annular chamber 11 is again illustrated to a slightly larger scale in FIG. 2 and comprises a preliminary chamber 11*a* which is connected to the operating chamber 2*c* via the first gap 8 and to the remainder of the annular chamber 11 via a second gap 12. It is delimited by a portion of the fixed cylinder 9 and two peripheral flanges 13, 14 which are securely connected to the cylinder 9. The remaining delimitation is formed by a cylindrical delimiting wall 15 which rotates with the cylinder 10 and which is provided with a plurality of openings 16. Any material which may be introduced from the operating chamber 2*a* into the preliminary chamber 11*a* via the gap 8 consequently reaches the remaining portion of the annular chamber 11 via the openings 16, in a region in which a lifting device 17 comprising a plurality of lifting shovels is arranged. The lifting shovels are securely connected to the rotating cylinder 10 and consequently convey the material falling through the openings 16 in front of the lifting shovels upwards owing to the rotating movement of the rotary pipe.

Figure 3:
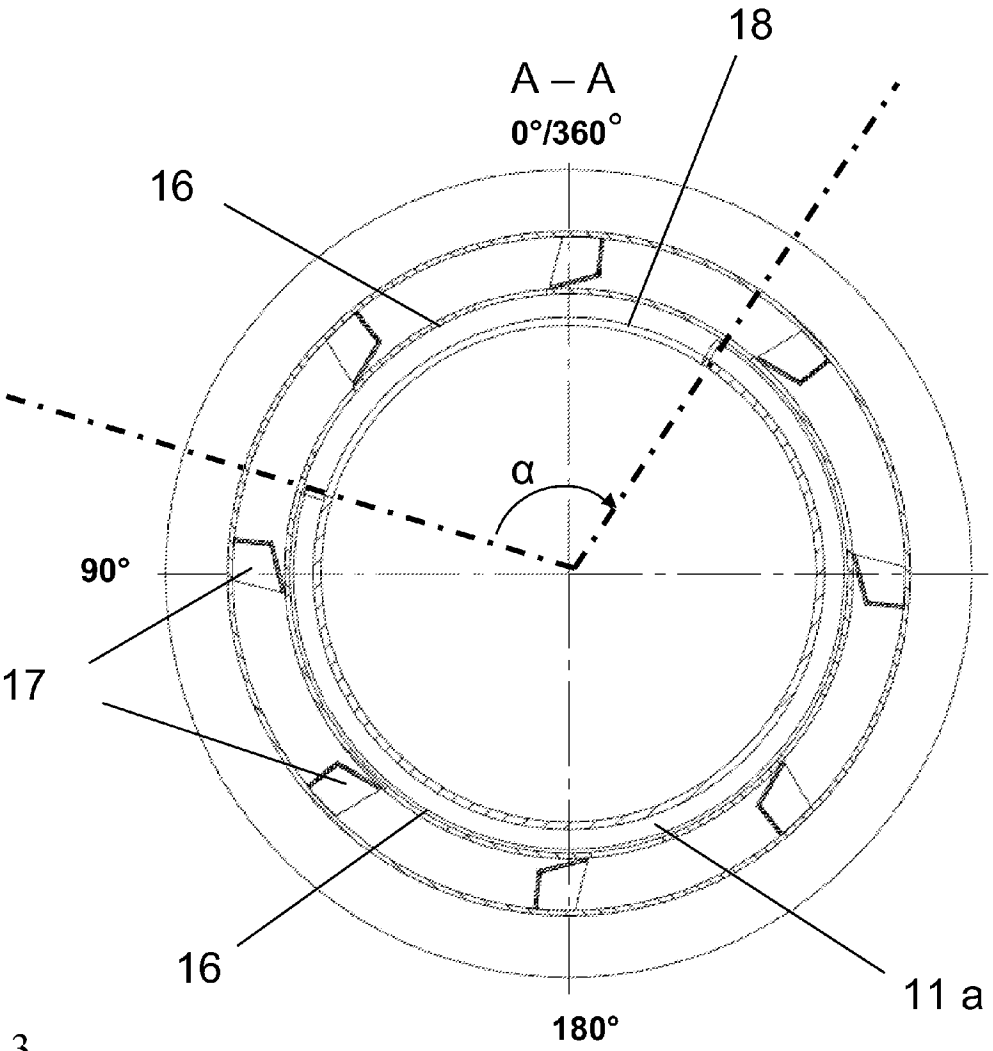
FIG. 3 is a sectional illustration along the line A-A of FIG. 1

In the upper region thereof, the annular chamber 11 has a discharge opening 18 constructed in the fixed cylinder 9. As can be seen particularly in FIG. 3, that discharge opening extends, for example, from the 10 o'clock position as far as the 1 o'clock position, that is to say, an angle $\alpha$ of, for example, approximately 90°. The material conveyed upwards with the lifting device 17 is then conveyed back into the operating chamber 2*c* through the openings 16 of the preliminary chamber 11*a* and the discharge opening 18. The discharge opening 18 has such dimensions that it is always located above the material level which is adjusted during normal operation of the rotary pipe so that material from the operating chamber 2*c* is prevented from reaching the annular chamber via the discharge opening 18.

In addition to the lifting device 17, there are further provided in the remaining region of the annular chamber 11 guiding elements 19 which are constructed in the manner of a screw conveyor and are arranged in such a manner that they convey into the lifting device 17 any material which is introduced into the region of the guiding elements with a predetermined direction of rotation of the rotary pipe 2. That material is particularly material which is not immediately picked up by the lifting shovels 17 and material which is introduced through the second gap 12.

Figure 4:
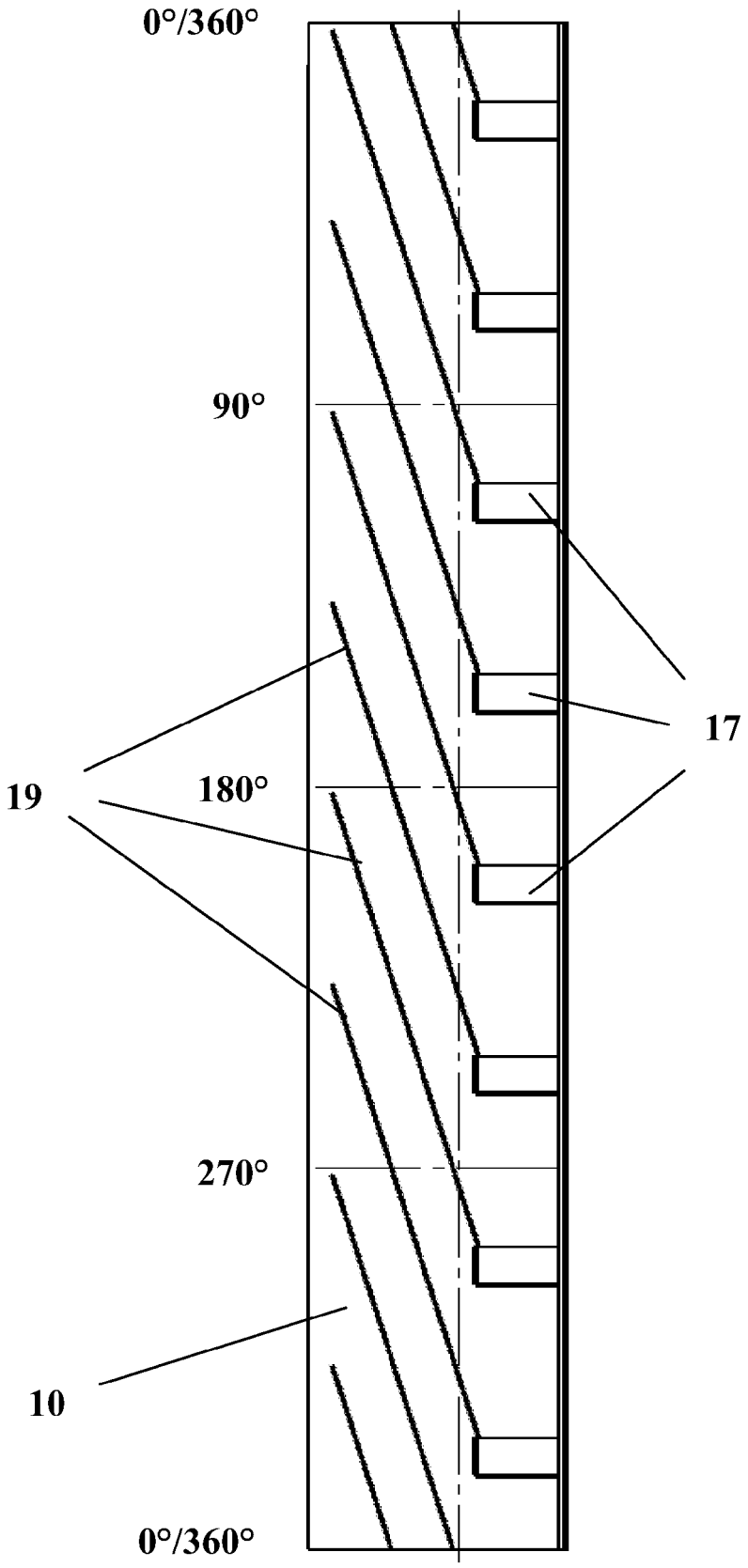
FIG. 4 is a developed view of the annular chamber with a lifting device and guiding elements.

The cooperation between the lifting device 17 and the guiding elements 19 is also very readily apparent from the developed view according to FIG. 4.

The end of the annular chamber 11 that is remote from the operating chamber 2*c* is delimited by the static end wall. In this regard, a third gap 20 which connects the annular chamber 11 to an overflow device 21 is formed between the co-rotating cylinder 10 and the end wall 4. The gas seal 7 to be protected is arranged only downstream of a fourth gap 22 which is formed between the fixed overflow device 21 and the co-rotating cylinder 10.

It is possible reliably to prevent a substantial portion of material from reaching the gas seal 7 with a combination of the three means (lifting device 17, guiding elements 19 and overflow device 21) so that the service-life thereof can be substantially extended.

The invention claimed is:

1. An industrial oven having a rotary pipe with an operating chamber defined by the portion of the rotary pipe acted upon by material that is supplied to the rotary pipe by a fixed material supply device connected proximate a front-face opening of the rotary pipe, there being provided between the rotary pipe and the fixed material supply device a sealing arrangement comprising a gas seal which is delimited from the operating chamber by at least a first gap between the rotary pipe and the material supply device characterised in that the sealing arrangement has an annular chamber and a lifting device, the annular chamber being provided between the first gap and the gas seal and having a discharge opening communicating with the operating chamber and receiving material from the operating chamber through the first gap, the lifting device being provided in the annular chamber in order to lift material out of the annular chamber and convey it back to the operating chamber through the discharge opening, and further characterised in that guiding elements are provided in a region of the annular chamber, the guiding elements being constructed in the manner of a screw conveyor and oriented in such a manner that they convey any material reaching the guiding elements into the lifting device with a predetermined direction of rotation of the rotary pipe.

2. An industrial oven according to claim 1, wherein the discharge opening is fixed above a material level formed during operation of the rotary pipe.

3. An industrial oven according to claim 1, characterised in that the sealing arrangement comprises a fixed cylinder connected to the material supply device, and a cylinder that rotates with the rotary pipe, wherein the annular chamber is delimited by the two cylinders.

4. An industrial oven according to claim 3, characterised in that the discharge opening is in the fixed cylinder.

5. An industrial oven according to claim 1, characterised in that the lifting device is formed by a plurality of lifting shovels arranged so as to be distributed over the periphery of the rotary pipe within the annular chamber, the lifting shovels rotating with the rotary pipe.

6. An industrial oven according to claim 1, characterised in that there is delimited in the annular chamber a preliminary annular chamber communicating with the operating chamber via the first gap and communicating with the remainder of the annular chamber via a second gap, the preliminary annular chamber having a delimiting wall that rotates with the rotary pipe, the delimiting wall having a plurality of openings positioned between the first and second gaps such that at least a portion of any material introduced into the preliminary annular chamber via the first gap reaches the lifting device directly through the plurality of openings.

7. An industrial oven according to claim 3, wherein the rotary pipe includes an end-face opening, the industrial oven further characterised in that the material supply device has a static end wall, with which the end-face opening of the rotary pipe is closed.

8. An industrial oven according to claim 7, characterised in that the material supply device comprises a supply chute, which opens in the fixed cylinder, which is secured to the end wall.

9. An industrial oven according to claim 8, characterised in that a third gap, which connects the annular chamber to an overflow device, is provided between the cylinder and the end wall, and the cylinder rotates with the rotary pipe.

10. An industrial oven having a rotary pipe with an operating chamber defined by the portion of the rotary pipe acted upon by material that is supplied to the rotary pipe by a fixed material supply device connected proximate a front-face opening of the rotary pipe, there being provided between the rotary pipe and the fixed material supply device a sealing arrangement comprising a gas seal which is delimited from the operating chamber by at least a first gap between the rotary pipe and the material supply device characterised in that the sealing arrangement has an annular chamber and a lifting device, the annular chamber being provided between the first gap and the gas seal and having a discharge opening communicating with the operating chamber and receiving material from the operating chamber through the first gap, the lifting device being provided in the annular chamber in order to lift material out of the annular chamber and convey it back to the operating chamber through the discharge opening, and further characterised in that guiding elements are provided in a region of the annular chamber, the guiding elements being constructed in the manner of a screw conveyor and oriented in such a manner that they convey any material reaching the guiding elements into the lifting device with a predetermined direction of rotation of the rotary pipe, the industrial over further characterised in that there is delimited in the annular chamber a preliminary annular chamber communicating with the operating chamber via the first gap and communicating with the remainder of the annular chamber via a second gap, the preliminary annular chamber having a delimiting wall that rotates with the rotary pipe, the delimiting wall having a plurality of openings positioned between the first and second gaps such that at least a portion of any material introduced into the preliminary annular chamber via the first gap reaches the lifting device directly through the plurality of openings, wherein said annular chamber is formed of the preliminary annular chamber and a remaining region, the preliminary annular chamber communicating with the remaining region through the second gap, the guiding elements being positioned in the remaining region and feeding material to the lifting device when material introduced into the preliminary annular chamber via the first gap passes the discharge opening and the second gap to enter the remaining region.

* * * * *